US010450109B2

(12) United States Patent
Blenkush et al.

(10) Patent No.: US 10,450,109 B2
(45) Date of Patent: Oct. 22, 2019

(54) TEXTURE SPRAYER BAG ROLLER EXTENSION

(71) Applicant: Graco Minnesota Inc., Minneapolis, MN (US)

(72) Inventors: William M. Blenkush, Becker, MN (US); Joshua D. Roden, Blaine, MN (US); Brett J. Carlson, Rogers, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 15/880,875

(22) Filed: Jan. 26, 2018

(65) Prior Publication Data

US 2018/0208367 A1 Jul. 26, 2018

Related U.S. Application Data

(60) Provisional application No. 62/450,785, filed on Jan. 26, 2017.

(51) Int. Cl.
*B65D 35/28* (2006.01)
*B65D 83/00* (2006.01)
(Continued)

(52) U.S. Cl.
CPC ..... *B65D 35/285* (2013.01); *B05B 7/144* (2013.01); *B65D 83/0072* (2013.01);
(Continued)

(58) Field of Classification Search
CPC .. B65D 35/285; B65D 83/30; B65D 83/0072; B05B 7/144
(Continued)

(56) References Cited

U.S. PATENT DOCUMENTS 4,167,235 A 9/1979 Green
4,966,311 A 10/1990 Taylor
(Continued)

FOREIGN PATENT DOCUMENTS

DE 102005016352 A1 10/2006
EP 0389919 A1 10/1990

OTHER PUBLICATIONS

MAI International GmbH. MAI®4SPARK—Airless spraying equipment [online], Feb. 13, 2008 [retrieved on Oct. 26, 2017] Retrieved from the Internet <URL: https://www.youtube.com/watch?v=qif2scdl_N4>.

(Continued)

*Primary Examiner* — Vishal Pancholi
(74) *Attorney, Agent, or Firm* — Kinney & Lange, P.A.

(57) ABSTRACT

An extendable bag roller for supporting a bag of material during removal of the material from the bag includes a bag support having a curved surface configured to support the bag of material on the curved surface and a roller that rolls along the curved surface of the bag support to squeeze the material out of the bag. The bag support includes a base defining a first portion of the curved surface of the bag support and an extension defining a second portion of the curved surface of the bag support, the extension being moveable to selectively increase and decrease the area of the curved surface of the bag support to accommodate different bag sizes.

20 Claims, 10 Drawing Sheets

(51) Int. Cl.

| | |
|---|---|
| ***B65D 83/30*** | (2006.01) |
| ***B65D 88/56*** | (2006.01) |
| ***B65D 88/28*** | (2006.01) |
| ***B05B 7/14*** | (2006.01) |
| ***B05B 13/00*** | (2006.01) |

(52) U.S. Cl.
CPC ..... *B65D 83/30* (2013.01); *B65D 88/56* (2013.01); *B05B 13/005* (2013.01); *B65D 88/28* (2013.01)

(58) Field of Classification Search
USPC ..... 222/101
See application file for complete search history.

(56) References Cited

U.S. PATENT DOCUMENTS

| | | | | |
|---|---|---|---|---|
| 5,033,706 | A | 7/1991 | Poulton | |
| 5,060,701 | A * | 10/1991 | McCunn ..... | A01C 15/006 137/614.04 |
| 5,069,596 | A | 12/1991 | Mueller et al. | |
| 5,184,759 | A | 2/1993 | Gill et al. | |
| 5,636,764 | A | 6/1997 | Bonerb | |
| 5,690,253 | A | 11/1997 | LaFleur | |
| 6,149,110 | A | 11/2000 | Gill et al. | |
| 7,086,428 | B2 | 8/2006 | Schroeder et al. | |
| 7,287,946 | B2 | 10/2007 | Bonerb | |
| 7,669,735 | B1 * | 3/2010 | Alleyne ..... | B65D 35/245 222/102 |
| 7,871,090 | B2 * | 1/2011 | Staub ..... | B05B 7/1404 280/47.35 |
| 2005/0167444 | A1 | 8/2005 | Sanfilippo et al. | |
| 2007/0017929 | A1 | 1/2007 | Bracht | |
| 2007/0108233 | A1 | 5/2007 | Grayden | |

OTHER PUBLICATIONS

Currierplastering. Graco bag roller [online], Feb. 18, 2015 [retrieved on Oct. 26, 2017] Retrieved from the Internet <URL:https://www.youtube.com/watch?v=dhqOXrtayYA>.

Extended European Search Report for EP Application No. 18250003.3, dated May 28, 2018, 7 Pages.

* cited by examiner

TEXTURE SPRAYER BAG ROLLER EXTENSION

CROSS-REFERENCE TO RELATED APPLICATION(S)

This application claims the benefit of U.S. Provisional Application No. 62/450,785 filed Jan. 26, 2017 for "TEXTURE SPRAYER BAG ROLLER EXTENSION" by William M. Blenkush, Joshua D. Roden, and Brett J. Carlson, which is fully incorporated by reference herein.

BACKGROUND

The present disclosure relates generally to heavy duty material sprayers, and in particular, to texture sprayers.

Texture sprayers are used to spray materials to cover surfaces, such as walls and ceilings. Material is supplied in bags and fed into the sprayer. The sprayer places the material under pressure, and the material is then sprayed from a gun or other outlet. Spraying can be continuously conducted as long as material is continuously supplied into the sprayer. A reservoir, such as a hopper, holds material within the sprayer and allows for mixing of material (such as mixing of a base and water) and/or continuous feeding of material to a pump despite exchanging material bags. Exchanging material bags can be cumbersome and messy.

SUMMARY

An extendable bag roller for supporting a bag of material during removal of the material from the bag includes a bag support having a curved surface configured to support the bag of material on the curved surface and a roller that rolls along the curved surface of the bag support to squeeze the material out of the bag. The bag support includes a base defining a first portion of the curved surface of the bag support and an extension defining a second portion of the curved surface of the bag support, the extension being moveable to selectively increase and decrease the area of the curved surface of the bag support to accommodate different bag sizes.

A method of extending a curved surface of a bag roller includes loosening a guide extending through a side of an extension connected to a front end of the bag roller, extending the extension from the front end of the bag roller, and tightening the guide to secure the extension to the bag roller in an extended position.

DETAILED DESCRIPTION

In general, the present disclosure describes an extension for a bag roller of a texture sprayer that allows for an adjustable increase in length of the curved surface of the base of the bag roller such that the bag roller can properly accommodate varied length bags. As such, longer length bags do not require repositioning during the emptying process. Likewise, shorter bags do not empty onto the surface of the base, which results in less product waste and clean-up, and shorter bags do not need to be placed off-center, which reduces the risk of bag slippage.

Figure 1:
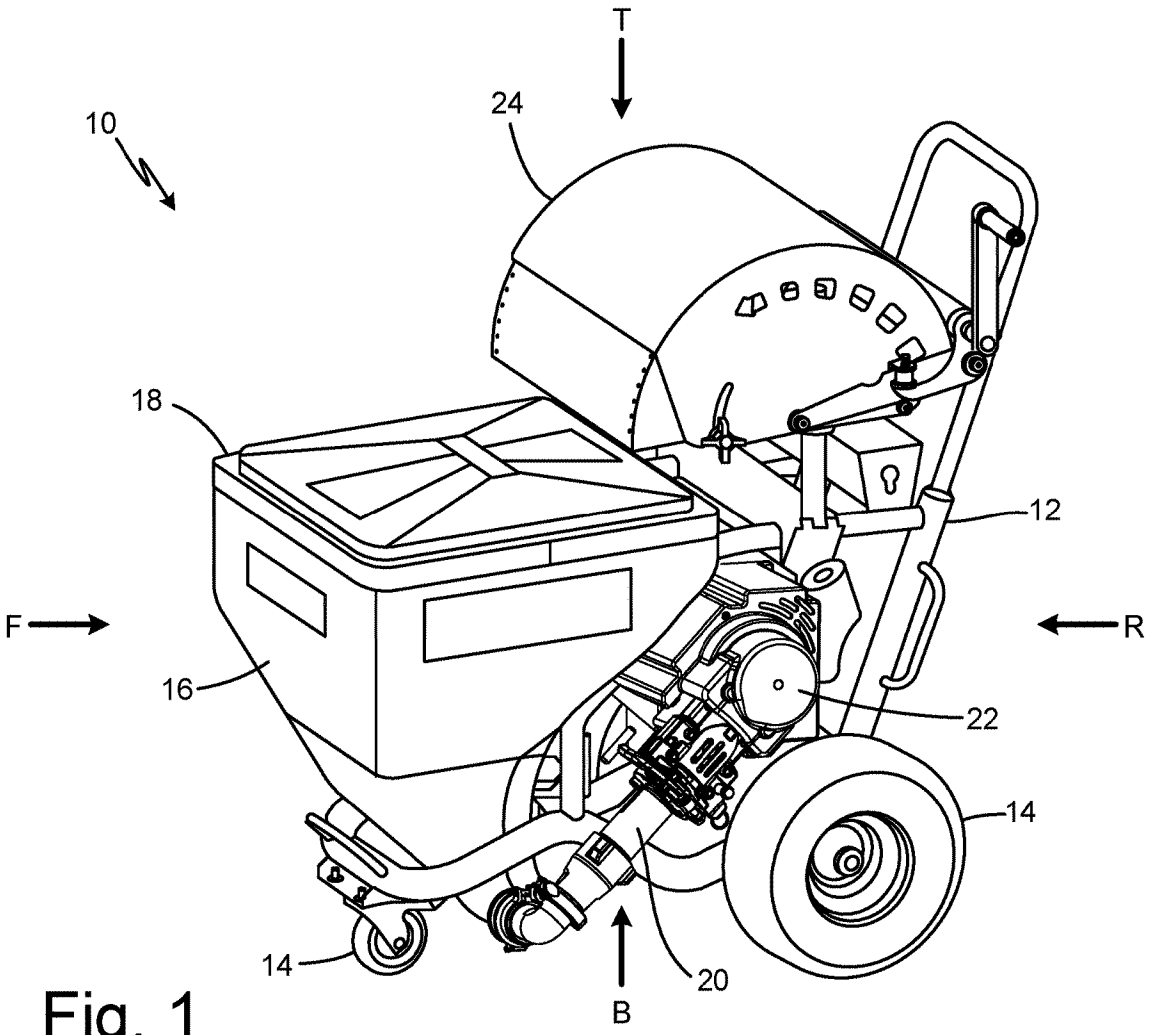
FIG. 1 is an isometric view of a sprayer.

FIG. 1 is an isometric view of sprayer 10. Also shown in FIG. 1 are top T, bottom B, front F, and rear R. Sprayer 10 includes frame 12, wheels 14, hopper 16, cover 18, pump 20, motor 22, and bag roller 24.

Sprayer 10 has top T, bottom B, front F, and rear R, which are used throughout the disclosure to describe the orientation and position of the components of sprayer 10.

Sprayer 10 is a material sprayer. Frame 12 of sprayer 10 is metal and supports the components of sprayer 10. Wheels 14 are connected to a bottom of frame 12. In this embodiment, one wheel 14 is connected at a front of frame 12 and two wheels 14 are connected at a rear of frame 12. Hopper 16 is connected to frame 12. Hopper 16 is a reservoir that contains material to be sprayed. Cover 18 is positioned over hopper 16. Pump 20 is connected to a bottom of hopper 16. Pump 20 can be a piston pump. Motor 22 is connected to pump 20. Motor 22 may be gas powered or electric powered. Bag roller 24 is mounted on frame 12 at least partially directly above hopper 16, such that an opening of hopper 16 is located below bag roller 24.

Frame 12 rolls on wheels 14. Cover 18 is removed from hopper 16 to allow material to be placed into hopper 16. Material is supplied in bags, such as plastic 40 to 50 pound bags. A bag of material is laid along a top surface of bag roller 24 and emptied into the opening of hopper 16. As such, bag roller 24 supports the bag of material during removal of the material from the bag. The material squeezed from the bag falls from the bag into the opening of hopper 16 of sprayer 10. Hopper 16 holds material within sprayer 10. Material may be mixed within hopper 16. Material in hopper 16 flows out of the bottom of hopper 16 to pump 20. Hopper 16 may continuously feed material to pump 20. Material can be continuously fed to pump 20 despite exchanging bags of material. Pump 20 receives the material from hopper 16. Pump 20 is driven by motor 22. Pump 20 operates to place the material under pressure. Pump 20 pumps the material for spraying. As such, the material can flow through a hose (not shown, but ordinarily attached to an output of pump 20) and be sprayed out of a gun (not shown), or other outlet, attached to the hose.

Material can be sprayed from sprayer 10 onto a desired surface, such as a wall or ceiling. Spraying can be continuously conducted as long as material is continuously supplied to hopper 16 of sprayer 10.

Figure 2:
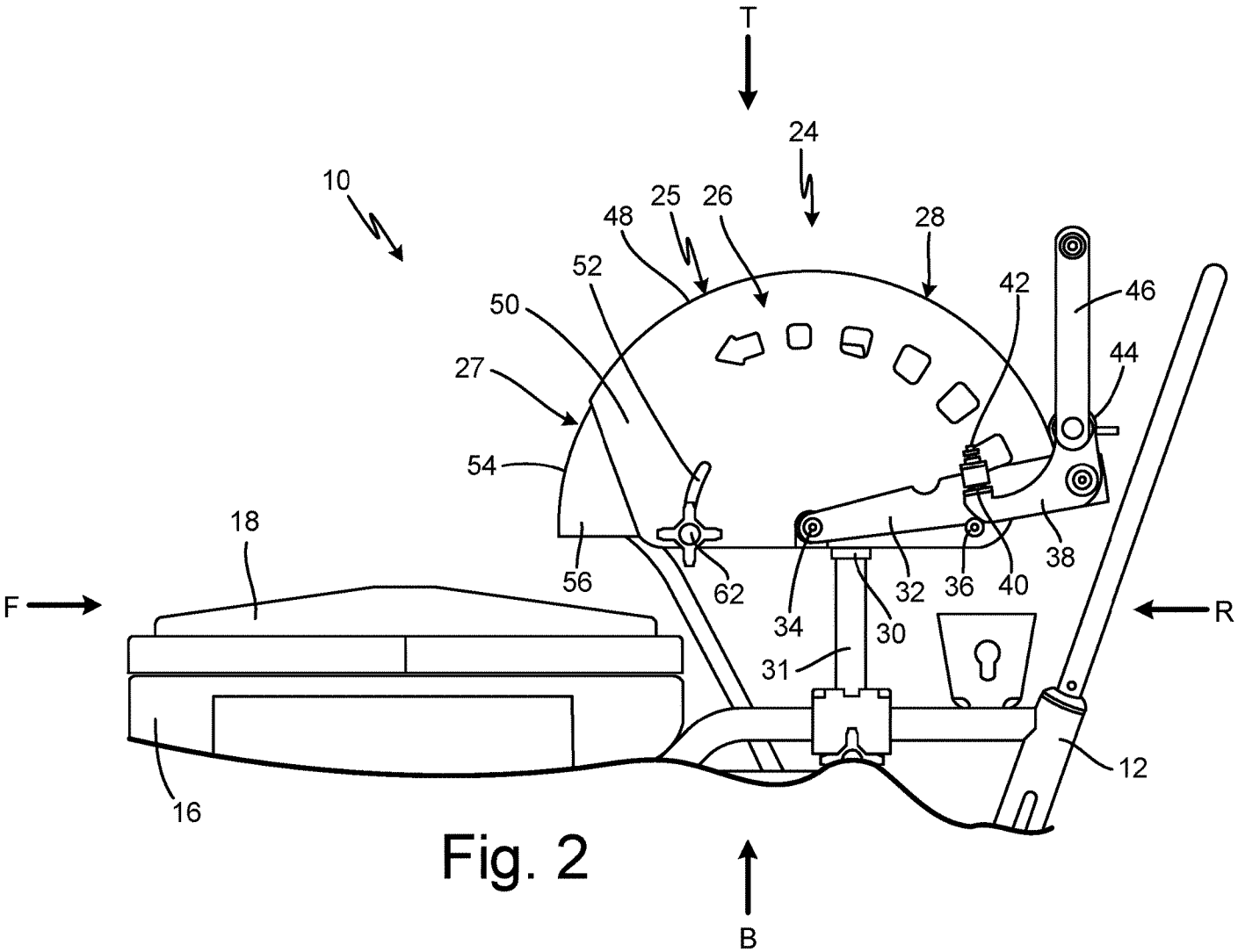
FIG. 2 is a partial side view of the sprayer showing the bag roller.
Figure 3:
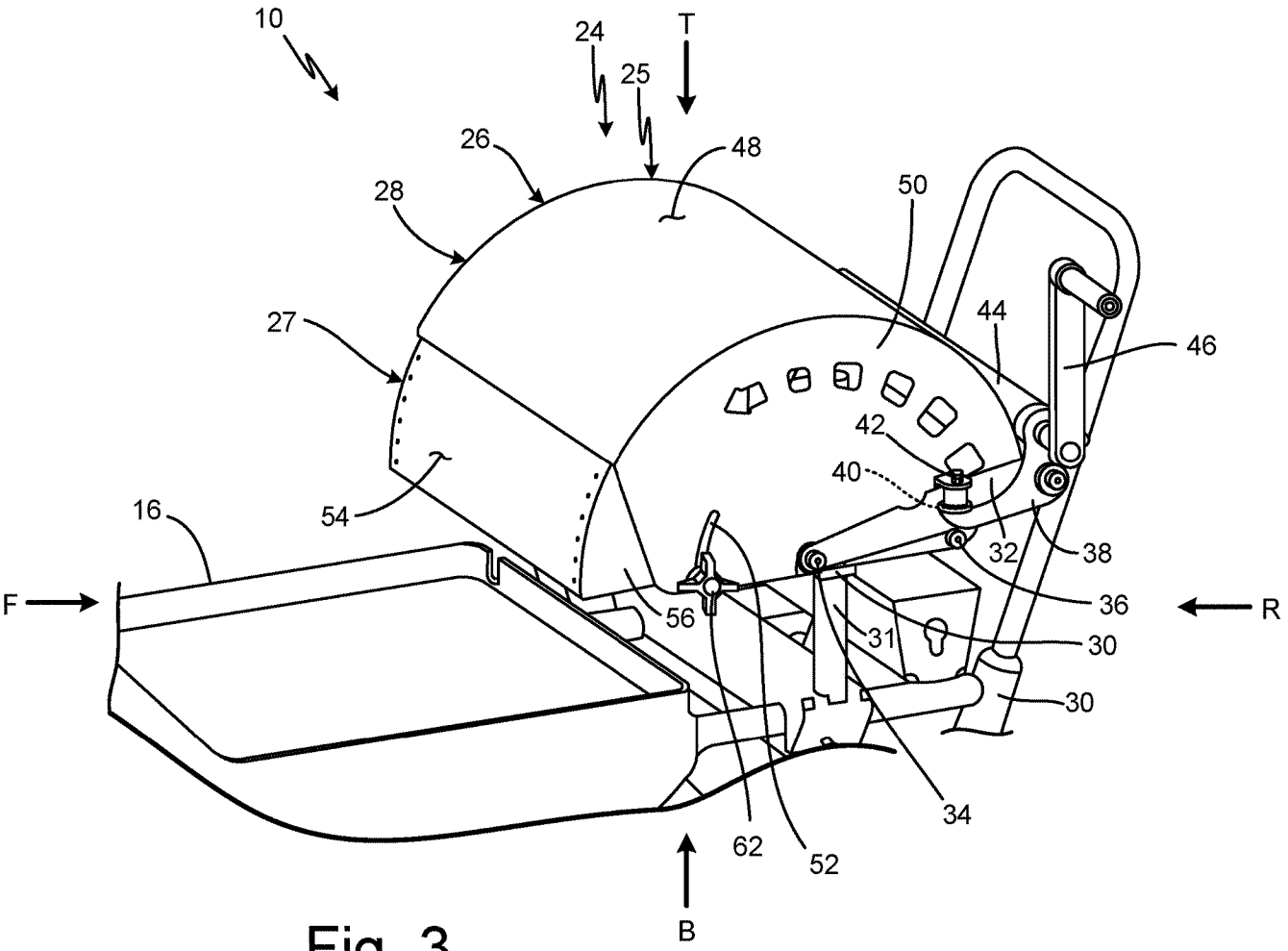
FIG. 3 is a partial isometric view of the sprayer showing the bag roller.
Figure 4:
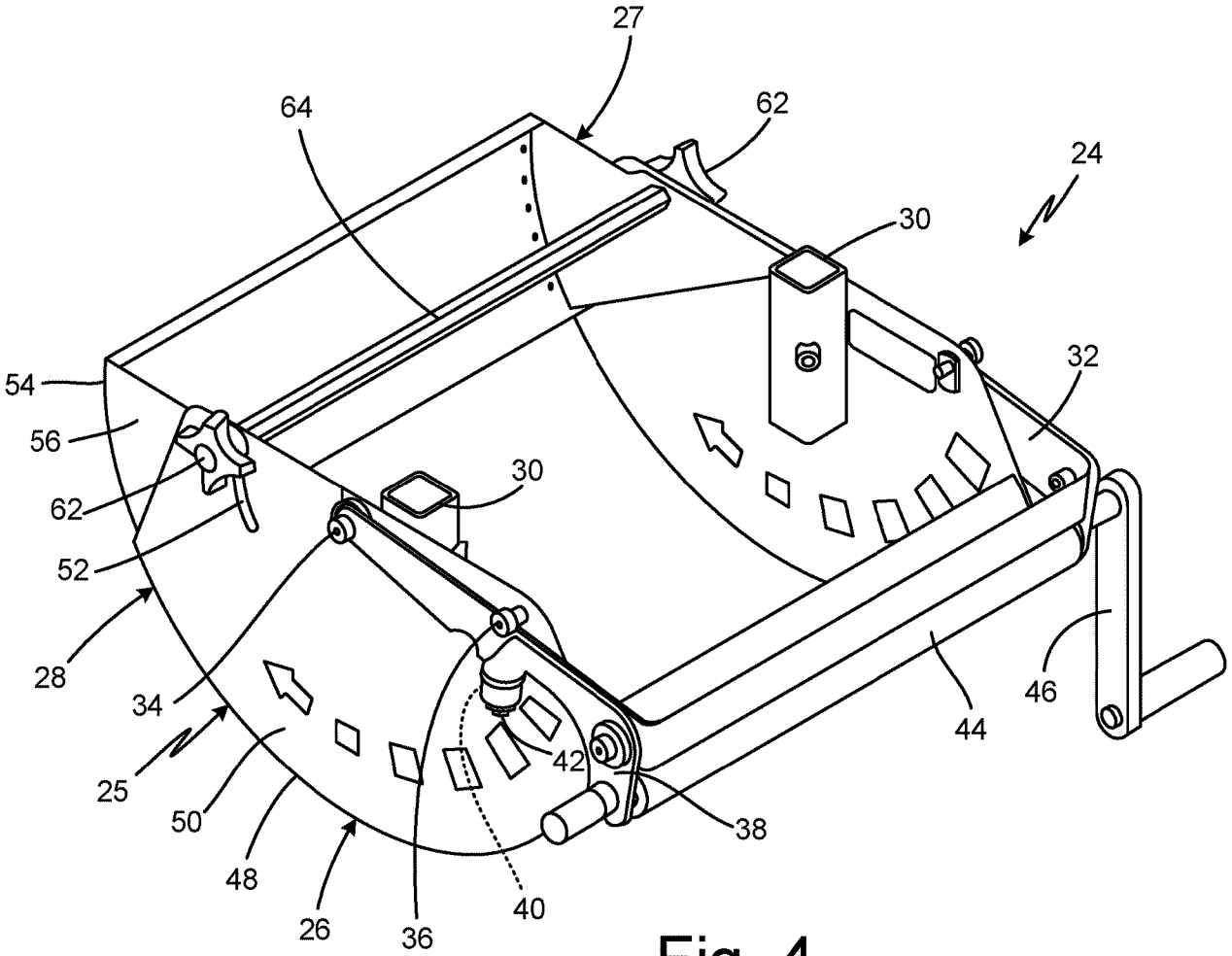
FIG. 4 is a bottom isometric view of the bag roller.
Figure 5:
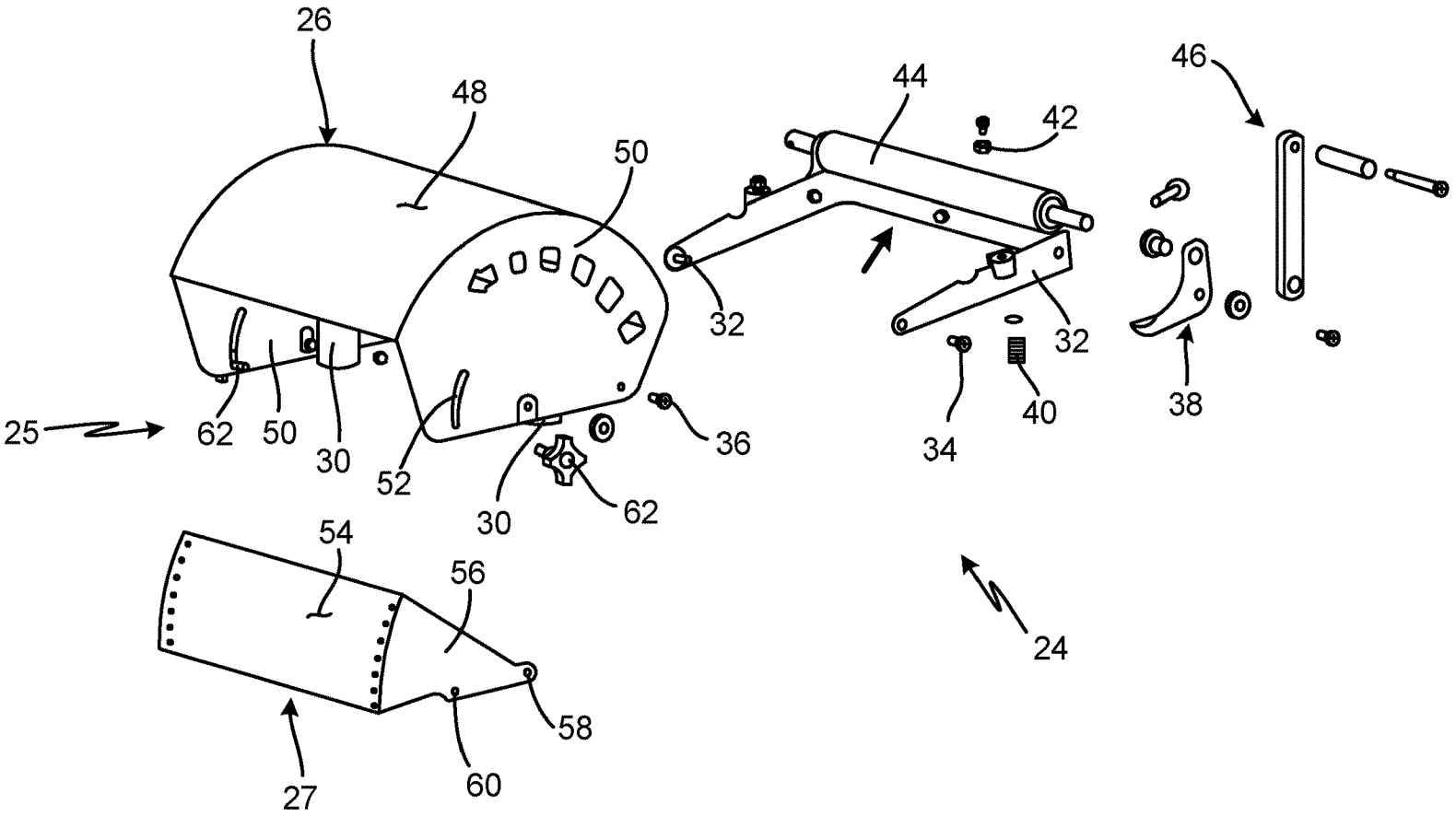
FIG. 5 is an exploded isometric view of the bag roller.
Figure 6B:
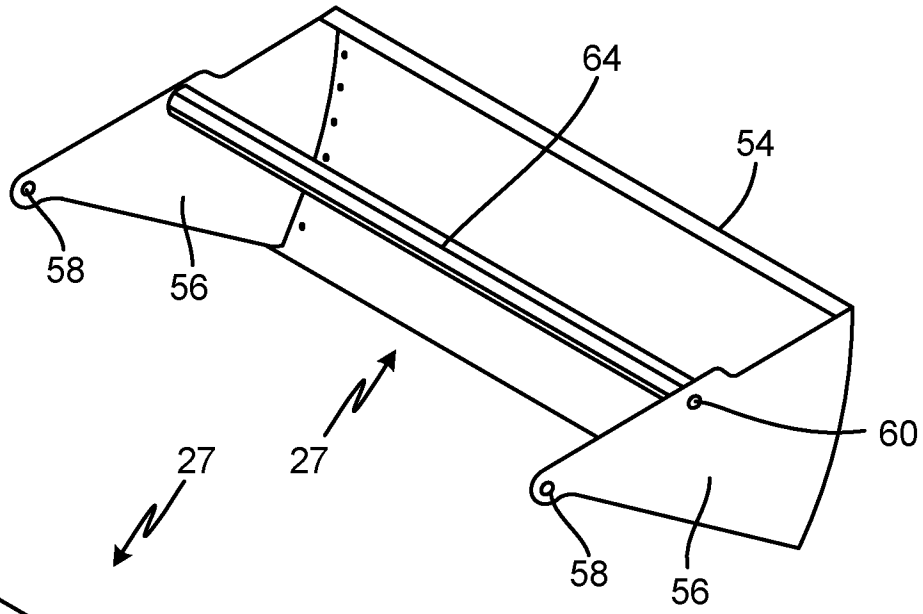
FIG. 6B is a rear isometric bottom view of the extension.
Figure 6A:
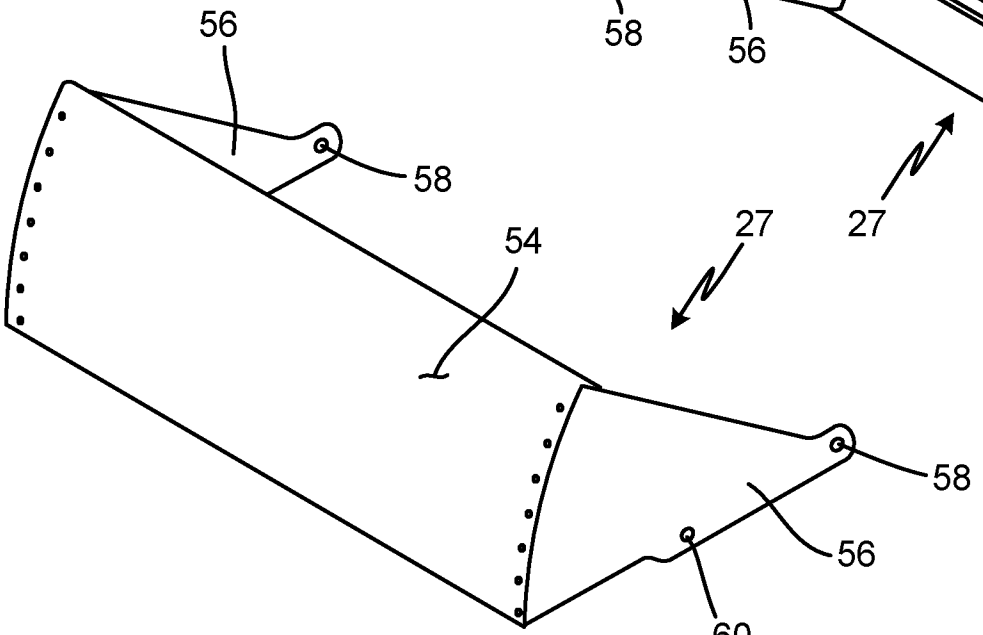
FIG. 6A is a front isometric view of the extension.

FIG. 2 is a partial side view of sprayer 10 showing bag roller 24. FIG. 3 is a partial isometric view of sprayer 10 showing bag roller 24. FIG. 4 is a bottom isometric view of bag roller 24. FIG. 5 is an exploded isometric view of bag roller 24. FIG. 6A is a front isometric view of extension 27. FIG. 6B is a rear isometric bottom view of extension 27. FIGS. 2-6B will be discussed together. Sprayer 10 includes frame 12 (shown in FIGS. 2 and 3), cover 18 (shown in FIG. 2), hopper 16 (shown in FIGS. 2 and 3), and bag roller 24 (shown in FIGS. 2-5). Bag roller 24 includes bag support 25 (which includes base 26, extension 27, and curved surface 28), mounts 30, bag roller frame 31 (shown in FIGS. 2 and 3), arm 32, fulcrum fastener 34, stops 36, spring loaded linkage 38, spring 40, nut 42, roller 44, and handle 46. Base 26 includes curved surface 48, base sides 50, and slots 52. Extension 27 includes curved surface 54, extension sides 56, fastener holes 58 (shown in FIGS. 5, 6A, and 6B), guide holes 60 (shown in FIGS. 5, 6A, and 6B), guides 62, and crossbar 64 (shown in FIGS. 4 and 6B).

Sprayer 10 is the same as described in reference to FIG. 1. A front end of bag roller 24 is located at least partially over hopper 16. Bag roller 24 has bag support 25, which is made up of base 26 and extension 27. Base 26 can be formed from metal plates which are welded, glued, and/or joined by fasteners. Extension 27 is attached to the front end of base 26. Extension 27 has a slightly smaller radius than a radius of base 26 to allow extension 27 to fit within, or nest inside, base 26. Top surfaces of base 26 and extension 27 make up curved surface 28 of bag support 25. Mounts 30 are connected to base 26. A first mount 30 is connected at a first side of base 26, and a second mount 30 is connected at a second side of base 26. Mounts 30 may be metal tubes inside which smaller similarly-shaped tubes of bag roller frame 31 fit. Threaded bolts can be inserted through the overlapping mounts 30 to contact the tubes of bag roller frame 31 and fix the positions of mounts 30 with respect to tubes of bag roller frame 31. In this embodiment, mounts 30 are square or rectangular. In alternate embodiments, mounts 30 may be any suitable shape. Bag roller frame 31 mounts to frame 12.

Arm 32 is connected to base 26. Arm 32 is U-shaped. As such, arm 32 has a first side, a second side, and an end extending between the first side and the second side of arm 32. An end of the first side of arm 32 is connected at a first side of base 26, and an end of the second side of arm 32 is connected at a second side of base 26. Arm 32 is connected to base 26 by fulcrum fasteners 34 such that arm 32 rotates about fulcrum fasteners 34. As such, bag roller 24 has a pair of fulcrum fasteners 34. A first fulcrum fastener 34 extends through a hole in the end of the first side of arm 32 and into base 26, and a second fulcrum fastener 34 extends through a hole in the end of the second side of arm 32 and into base 26. Each fulcrum fastener 34 may comprise a nut and a bolt or any other suitable fastener that can permit rotation. Stops 36 are fixed to each side of base 26. Each stop 36 is located adjacent a bottom of base 26 and a rear of base 26. Stops 36 are positioned to engage arm 32. Stops 36 may be threaded bolts that extend through holes in sides of base 26 and are attached to complementary fasteners, such as nuts, located at an inside of base 26. Spring loaded linkages 38 are rotatably attached to arm 32. A first spring loaded linkage 38 is attached at the first side of arm 32, and a second spring loaded linkage 38 is attached at the second side of arm 32. Spring loaded linkages 38 are braced by springs 38. As such, a first end of each spring loaded linkage 38 is adjacent spring 40. Nuts 42 are also adjacent springs 38. A second end of each spring loaded linkage 38 is connected to an end of roller 44. As such, roller 44 extends between spring loaded linkages 38. Roller 44 is cylindrical and rolls about a central axis. Roller 44 may rotate about an axle. Roller 44 can be metal, wood, polymer, ceramic, or any other suitable material. Handle 46 is attached to an end of roller 44 and an end of spring loaded linkage 38 attached to roller 44.

Base 26 defines curved surface 48. Curved surface 48 makes up a first portion of curved surface 28 of bag support 25. Curved surface 48 can be arcuate in shape. Curved surface 48 can be semi-circular in shape. Curved surface 48 generally faces upwards. Curved surface 48 can be formed from a curved plate. Fulcrum fasteners 34 may be located at a center of curvature of curved surface 48. Base sides 50 of base 26 are connected to curved surface 48. Each base side 50 is connected to a side of curved surface 48. Base sides 50 are connected on opposite sides of curved surface 48. Base sides 50 are flat. Base sides 50 follow curved sides of curved surface 48, thus base sides 50 have a curved top edge. As such, base sides 50 have a semi-circular shape. Mounts 30 are connected to base 26 at interiors of base sides 50. Base 26 has a mount 30 connected to each base side 50. Each side of arm 32 is connected to a base side 50. A fulcrum fastener 34 extends through each base side 50. A slot 52 is formed in each base side 50. Slots 52 are curved openings in base sides 50 and are positioned adjacent a bottom of base 26 near a front end of base 26. Slots 52 may have the same curvature as curved surface 48. Fulcrum fasteners 34 may be located at the center of curvature of slots 52.

Extension 27 defines curved surface 54. Curved surface 54 makes up a second portion of curved surface 28 of bag support 25. Curved surface 54 can be positioned just below curved surface 48 of base 26. Curved surface 54 can be substantially (or essentially) seamless with curved surface 48 of base 26 when extension 27 is in an extended position. Curved surface 54 is formed from a curved plate. A plate of curved surface 48 of base 26 and a plate of curved surface 54 of extension 27 may contact one another. In this embodiment, the curvature of curved surface 54 is the same as the curvature of curved surface 48 of base 26. In alternate embodiments, the curvature of curved surface 54 may be different than the curvature of curved surface 48 of base 26. Curved surface 54 may be about five inches (about 12.7 centimeters) in length (front-to-rear), or slightly longer. Curved surface 54 may be any suitable length, including longer than 5 inches and shorter than 5 inches. In alternate embodiments, extension 27 may have a flat surface instead of curved surface 54.

Extension sides 56 of extension 27 are connected to curved surface 54. An outer end of a first extension side 56 is connected to a first side of curved surface 54, and an outer end of a second extension side 56 is connected to a second side of curved surface 54. Extension sides 56 are flat and wedge or pie shaped. Extension sides 56 are parallel, or aligned, with base sides 50. The distance between extension sides 56 of extension 27 is only slightly less than the distance between base sides 50 of base 26 such that extension sides 56 fit between base sides 50. Extension sides 56 may contact base sides 50. Fastener holes 58 extend through extension sides 56. A fastener hole 58 extends through each extension side 56 at an inner end of each extension side 56 and in a position to receive a fulcrum fastener 34. Fulcrum fasteners 34 extend through fastener holes 58. Guide holes 60 extend through extension sides 56. A guide hole 60 extends through each extension side 56 near a bottom of each extension side 56 between the inner end and an outer end of each extension side 56 and in a position to receive a guide 62. Guides 62 extend through slots 52 in base sides 50 and through guide holes 60 in extension sides 56. As such, guides 62 are located at base sides 50. Guides 62 may be pins that rigidly attach to extension sides 56. Guides 62 may include knobs for a user to grip. A base side 50 of bag roller 44 and an extension side 56 are positioned between each guide 62 and an end of crossbar 64. Crossbar 64 is coaxial with guides 62. Crossbar 64 extends from a first extension side 56 at guide hole 60 to a second extension side 56 at guide hole 60. Crossbar 64 may have a threaded hole at each end of crossbar 64 into which a guide 62 can be threaded.

While various types of fasteners are shown and described for attaching the various components of sprayer 10, any suitable type of fastener may be used.

Mounts 28 are used to attach bag roller 24 to frame 12. Fulcrum fasteners 34 attach arm 32 to base sides 50 of base 26 of bag roller 24 while allowing rotation of arm 32 about fulcrum fasteners 34. Stops 36 prevent arm 32 from rotating below base 26 at a rear of base 26. Arm 32 guides roller 44 to roll along curved surface 28 of bag support 25, made up of curved surface 48 of base 26 and curved surface 54 of extension 27. When stops 36 engage arm 32 to prevent further rearward motion of arm 32, roller 44 is prevented from rolling off of curved surface 28 of bag support 25. Spring loaded linkages 38 use springs 38 to maintain pressure by roller 44 on curved surface 28 of bag support 25, and thus, on curved surface 48 of base 26 and curved surface 54 of extension 27. The tension in spring 40 increases or decreases the pressure that roller 44 places on curved surface 28. The tension in spring 40 is adjustable by rotating nut 42. Handle 46 is for manual operation of bag roller 24 by a user. Handle 46 is attached to roller 44 so that a user can pull or push on handle 46 to move roller 44 along curved surface 28.

Bag support 25 supports a bag of material on curved surface 28. Extension 27 can be extended or retracted, as desired by a user, to selectively increase and/or decrease a length of curved surface 28 along which a bag is laid. For example, curved surface 54 may provide about five inches of variably extendable length to curved surface 48 of base 26 such that bag roller can accommodate bags between about 19 inches and about 24 inches. Curved surface 54 provides a surface for front ends of bags of material. Extension 27 is moveable between an extended position and a retracted position. Curved surface 48 of base 26 and curved surface 54 of extension 27 may slide relative to one another during extension and retraction of extension 27. In a retracted position, part of curved surface 54 is underneath base 26. In an extended position, part of curved surface 54 is extended beyond base 26 to contact and support the bag of material. Extension 27 extends and retracts by rotating about fulcrum fasteners 34. Extension 27 extends along the same axis as curved surface 48 of base 26. Guides 62 fasten extension 27 to bag roller 24 at a desired position. A user may grip knobs of guides 62 when making adjustments to the position of extension 27. Movement of guides 62 within slots 52 limits the movement of extension 27 to rotational movement about fulcrum fasteners 34. Crossbar 64 accepts guides 62 to fasten extension 27 to base 26, and crossbar 64 structurally supports extension 27.

To empty material into hopper 16, cover 18 is removed from hopper 16. A bag of material is placed on curved surface 28 of bag support 25 of bag roller 24. As such the bag is placed on curved surface 48 of base 26 and curved surface 54 of extension 27. A bag is typically laid in a front-to-rear orientation, with a rearward end of the bag attached to a rear of bag roller 24. A front of the bag is opened on its forward end, which is positioned at a front edge of curved surface 28. When extension 27 is extended, the bag is at a front edge of curved surface 54 (which makes up a front edge of bag support 25). Curved surfaces 48 and 54 support the bag of material that is laid along bag roller 24. Handle 46 is pulled or pushed such that roller 44 rolls over the bag placed on curved surface 28, and thus rolls over curved surfaces 48 and 54, to squeeze material out of the bag. A front of bag roller 24 overlaps with hopper 16 such that material exits the open front end of the bag and falls into hopper 16.

Traditionally, bag rollers 24 do not include extension 27. Without extension 27, a long bag would not fit on curved surface 48 of base 26. As a result, all of the material in the bag cannot be squeezed out by roller 44 rolling along curved surface 48. A user is required to partially squeeze out material from the bag, readjust the bag along curved surface 48 of base 26, and then continue squeezing the bag via roller 44. Further, if curved surface 48 is sized to fit long bags, shorter bags would empty onto curved surface 48 rather than fall directly into the opening of hopper 16. As a result, material is wasted and is at risk of being contaminated, and bag roller 24 is dirtied and requires clean-up. Alternatively, shorter bags would be placed off-center with respect to the apex of bag roller 24 (e.g. the center of the bag is not positioned on the apex of bag roller 24) to avoid the material falling onto curved surface 48. Such forward leaning placement of a bag risks the bag slipping off the front side of bag roller 24 due to instability (front-to-rear) about the apex of curved surface 48 of base 26.

Curved surface 54 allows the total length of curved surface 28 of bag support 25 to be adjustable such that bag roller 24 is extendable to fit, or accommodate, different bag sizes. Curved surface 54 of extension 27 can effectively extend the total length of curved surface 28 of bag support 25 to the length of curved surface 48 plus the length of curved surface 54. Extension 27 can be extended or retracted to increase or decrease the area of curved surface 28 until curved surface is appropriate for the size of the bag. Thus, extension 27 allows bag roller 24 to accommodate bags having a variety of sizes, the forward end of each bag being positioned at a front edge of curved surface 28 and the material in the bag falling directly into hopper 16. Specifically, extension 27 allows for proper positioning (with respect to the front end of curved surface 48 and hopper 16) and proper balance (with respect to the apex of curved surfaces 48 and 54) of bags of different lengths on bag roller 24. As a result, extendable bag roller 24 completely empties bags of material with no waste or mess.

Figure 7A:
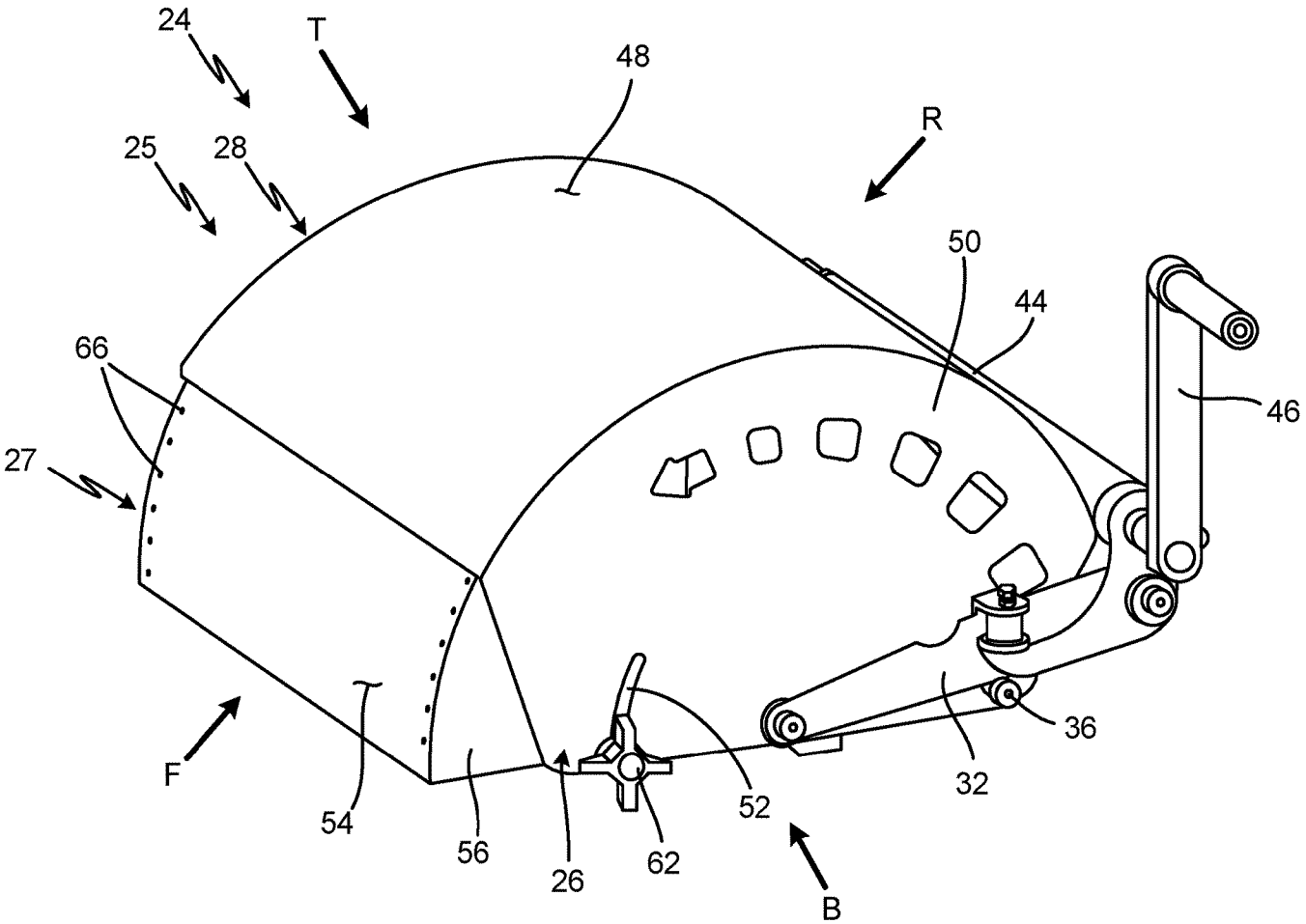
FIG. 7A is an isometric view of the bag roller with an extension in a fully extended position and a roller in a rearward position.
Figure 7B:
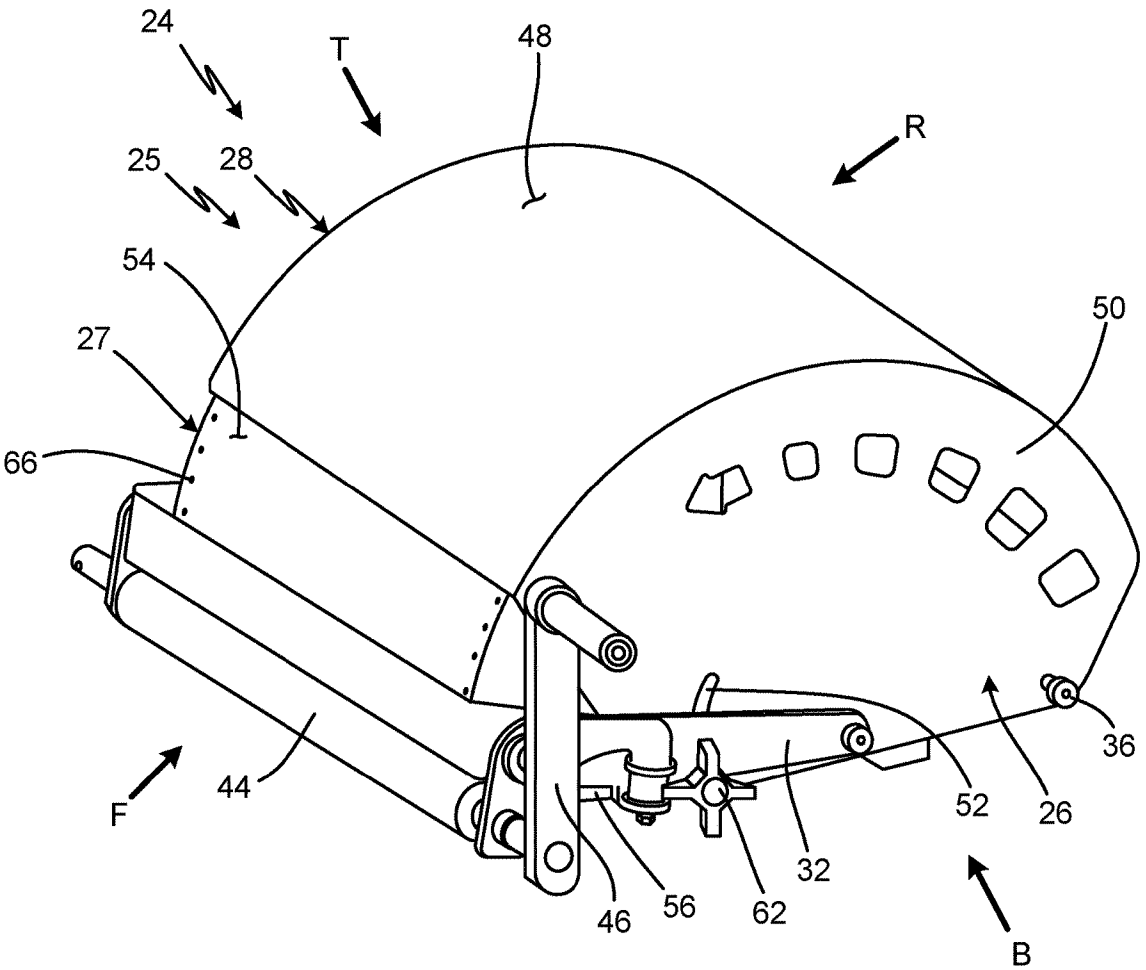
FIG. 7B is an isometric view of the bag roller with the extension in the fully extended position and the roller in a forward position.
Figure 8A:
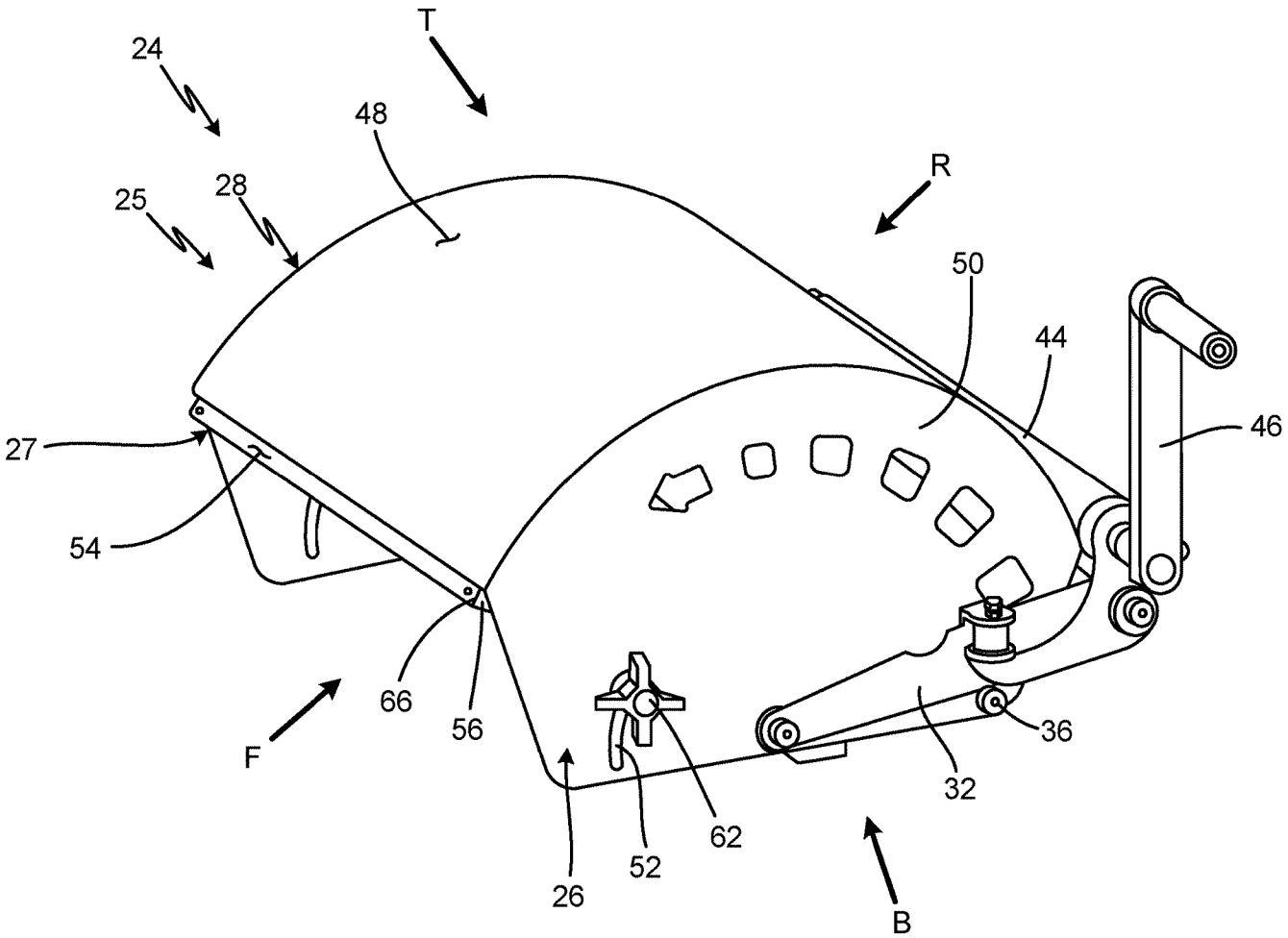
FIG. 8A is an isometric view of the bag roller with the extension in a fully retracted position and the roller in the rearward position.
Figure 8B:
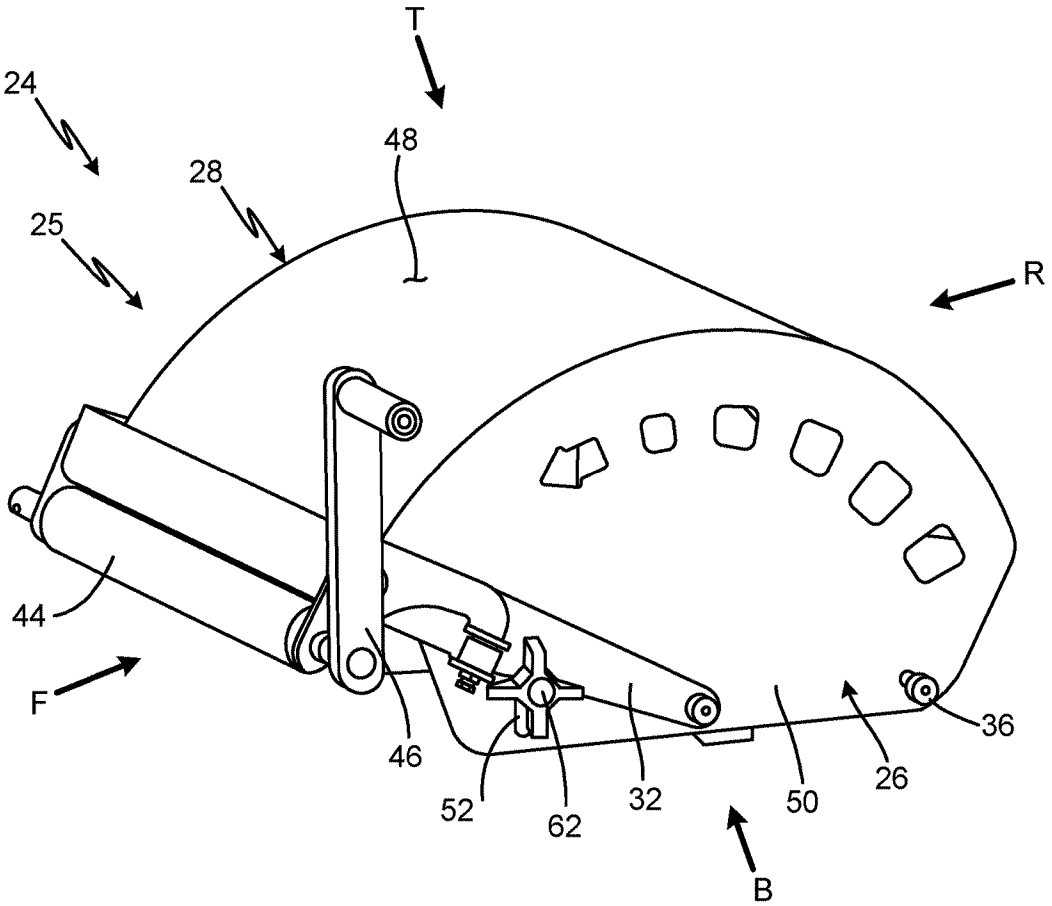
FIG. 8B is an isometric view of the bag roller with the extension in the fully retracted position and the roller in the forward position.

FIG. 7A is an isometric view of bag roller 24 with extension 27 in a fully extended position and roller 44 in a rearward position. FIG. 7B is an isometric view of bag roller 24 with extension 27 in the fully extended position and roller 44 in a forward position. FIG. 8A is an isometric view of bag roller 24 with extension 27 in a fully retracted position and roller 44 in the rearward position. FIG. 8B is an isometric view of bag roller 24 with extension 27 in the fully retracted position and roller 44 in the forward position. FIGS. 7A-8B will be discussed together. Bag roller 24 includes bag support 25 (which includes base 26, extension 27 (shown in FIGS. 7A, 7B, and 8A), and curved surface 28), arm 32, stops 36, roller 44, and handle 46. Base 26 includes curved surface 48, base sides 50, and slots 52. Extension 27 includes curved surface 54, extension sides 56, guides 62 and graduation marks 66.

Bag roller 24 is the same as described in reference to FIGS. 1-6B. Graduation marks 66 are located on curved surface 54 of extension 27. In alternate embodiments, graduation marks 66 can be provided on extension sides 56 of extension 27. Further, in alternate embodiments, graduation marks 66 can be provided on base sides 50 of base 26. Graduation marks 66 may be small holes extending through curved surface 54 or any other suitable visual indicator.

FIGS. 7A and 7B show extension 27 in a fully extended position while FIGS. 8A and 8B show extension in a fully retracted position. Extension 27 is may also be extended or retracted into any position between the fully extended position and the fully retracted position. Guides 62 can be loosened, such as by unthreading guides 62 from fixed attachment to base sides 50 and extension sides 56, to allow extension 27 to extend and retract relative to base 26 to allow relative movement, or rotation of, extension 27 with respect to base 26. When retracting extension 27, extension 27 slides under a bottom of curved surface 48 of base 26 to decrease the length of curved surface 54 of extension 27 that is exposed. Extension 27 may be retracted entirely underneath base 26 in a fully retracted position.

Graduation marks 66 measure the length of exposed curved surface 54 for particular bag sizes. Graduation marks 66 can be used to record positions of extension 27, or degrees of extension of extension 27, for specific bag lengths. Graduation marks 66 provided on extension 27, such as on curved surface 54, are measured against the forward edge of curved surface 48 or base sides 50. In alternate embodiments, graduation marks 66 on base sides 50 can be measured against the position of guides 62. As such, graduation marks 66 can be aligned with base 26 to indicate the degree to which extension 27 should be extended to accommodate various bag sizes.

When extension 27 is in a user preferred position relative to base 26, guides 62 can be tightened, such as by threading guides 62 inwards. Guides 62 may thread into holes at ends of crossbar 64. Tightening guides 62 pinches base sides 50 between extension sides 56 and guides 62, fixing the position of extension 27 relative to base 26. Extension 27 is ideally fixed in position relative to base 26 before a bag is placed on curved surfaces 48 and 54 and roller 44 is moved across curved surfaces 48 and 54. Movement of guides 62 within slots 52 limits the movement of extension 27. When extension 27 is in a fully extended position, as shown in FIGS. 7A and 7B, guides 62 are at a bottom-most position within slots 52. When extension 27 is in a fully retracted position, as shown in FIGS. 8A and 8B, guides 62 are at a top-most position within slots 52.

When extension 27 is fully extended, bag support 25 has curved surface 28 consisting of curved surface 48 and an entirety of curved surface 54, which is a maximum length of curved surface 28 of bag support 25. When extension 27 is fully retracted, bag support 25 has curved surface 28 consisting of curved surface 48, which is a minimum length of curved surface 28 of bag support 25.

FIGS. 7A and 8A show roller 44 in a rearward-most position. FIGS. 7B and 8B show roller 44 in a forward-most position. When roller 44 is in a rearward-most position, handle 46 and arm 32 are in a rearward-most position. Arm 32 is contacting stops 36, which prevents arm 34 from moving below a bottom of bag support 25. When roller 44 is in a forward-most position, handle 46 is in a forward-most position. Guides 62 serve as forward stops to arms 32. Guides 62 engage arms 32 to prevent further forward movement of arms 32 in order to prevent roller 44 from rolling off of the front of curved surface 28. As such, roller 44 is prevented from rolling off of the front of curved surface 48 of base 26 or off of curved surface 54 of extension 27 when extension 27 is extended. Guides 62 move along slots 52 as extension 27 moves. Thus, the position of guides 62 will change with the position of extension 27 so that guides 62 will always stop roller 44 from traveling off the front of extension 27, or curved surface 48 of base 26 when extension 27 is in a fully retracted position (as shown in FIGS. 8A and 8B).

When roller 44 and arm 32 are in a rearward-most position, a bag is allowed to be placed on a top of bag support 25 on curved surface 28, and thus on curved surfaces 48 and 543244. The bag can be opened on its forward end. The opening of the bag is located at an edge of extension 27 when extension 27 is extended, or at an edge of curved surface 48 when extension is fully retracted, such that material can drop directly into hopper 16 (as shown in FIGS. 1-3).

When roller 44 is moved to a forward position by handle 46, roller 44 moves forward over curved surface 28, and thus over curved surface 48 and curved surface 54, if extension 27 is extended. As such, roller 44 rolls over a bag on bag support 25. In some instances, roller 44 may not even contact curved surface 54 of extension 27 despite being rolled as far forward as possible. The rear-to-front rolling action of roller 44 as roller 44 rolls on and over the bag squeezes material out of the bag and into hopper 16.

The adjustability of extension 27 allows material bags of different lengths to be properly located on bag roller 24. Extension 27 allows the curved surface of bag roller 24 to be adjustable to infinite positions to accommodate material bags of different lengths to reduce repositioning of bag, product waste, and cleanup.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An extendable bag roller for supporting a bag of material during removal of the material from the bag, the extendable bag roller comprising:

- a bag support having a curved surface configured to support the bag of material on top of the curved surface, the bag support comprising:
  - a base defining a first portion of the curved surface of the bag support; and
  - an extension defining a second portion of the curved surface of the bag support, the extension being moveable to selectively increase and decrease the area of the curved surface of the bag support to accommodate different bag sizes; and
- a roller that rolls along the curved surface of the bag support to squeeze the material out of the bag.

2. The bag roller of claim 1, wherein the roller rolls along the first portion of the curved surface of the bag support and the second portion of the curved surface of the bag support.

3. The bag roller of claim 1, wherein the extension is moveable between a retracted position in which part of the second portion of the curved surface of the bag support is underneath the base, and an extended position in which the part of the second portion of the curved surface of the bag support is extended beyond the base to contact and support the bag of material.

4. The bag roller of claim 1, wherein the second portion of the curved surface of the bag support is positioned underneath the base such that the extension is fully below the base when the extension is in a fully retracted position.

5. The bag roller of claim 1, wherein the second portion of the curved surface of the bag support is substantially seamless with the first portion of the curved surface of the bag support when the extension is in an extended position.

6. The bag roller of claim 1, wherein the second portion of the curved surface of the bag support has the same curvature as a curvature of the first portion of the curved surface of the bag support.

7. The bag roller of claim 1, wherein the second portion of the curved surface of the bag support is about five inches (about 12.7 centimeters) in length.

8. The bag roller of claim 1, further including graduation marks located on the extension.

9. The bag roller of claim 8, wherein the graduation marks are holes in the second portion of the curved surface of the bag support.

10. An extendable bag roller for supporting a bag of material during removable of the material from the bag, the extendable bag roller comprising:

a bag support having a curved surface configured to support the bag of material on the curved surface, the bag support comprising:

a base defining a first portion of the curved surface of the bag support; and an extension defining a second portion of the curved surface of the bag support, the extension being movable to selectively increase and decrease the area of the curved surface of the bag support to accommodate different bag sizes; and a roller that rolls along the curved surface of the bag support to squeeze the material out of the bag;

wherein the extension includes:

a curved surface making up the second portion of the curved surface of the bag support;

a side connected to the curved surface of the extension at an outer end of the side;

a fastener hole extending through the side at an inner end of the side, the fastener hole configured to accept a fastener of the bag roller;

a guide hole extending through the side; and a guide extending through the guide hole to secure the extension to the base of the bag support.

11. The bag roller of claim 10, wherein the side of the extension is wedge shaped.

12. The bag roller of claim 10, wherein the side of the extension is aligned with a side of the base of the bag support.

13. The bag roller of claim 10, wherein the extension further includes a second side connected to the curved surface of the extension at an outer end of the second side, wherein the distance between the sides of the extension is less than the distance between sides of the base of the bag roller such that the sides of the extension fit between the sides of the base.

14. The bag roller of claim 10, wherein the guide is configured to act as a forward stop to an arm of the bag roller.

15. The bag roller of claim 10, wherein the guide is configured to move along a slot in a side of the base of the bag roller.

16. The bag roller of claim 10, wherein the extension further includes:

a second side connected to the curved surface of the extension at an outer end of the second side;

a guide hole extending through the second side;

a guide extending through the guide hole in the second side to secure the extension to the base of the bag roller; and a crossbar extending between guide holes in each of the sides of the extension, wherein the crossbar is coaxial with the guides and accepts the guides to fasten the extension to the base of the bag roller.

17. An extendable bag roller for supporting a bag of material during removal of the material from the bag, the extendable bag roller comprising:

a bag support having a curved surface configured to support the bag of material on the curved surface, the bag support comprising:

a base defining a first portion of the curved surface of the bag support; and an extension defining a second portion of the curved surface of the bag support, the extension being moveable to selectively increase and decrease the area of the curved surface of the bag support to accommodate different bag sizes; and a roller that rolls along the curved surface of the bag support to squeeze the material out of the bag;

wherein the extension is moveable between a retracted position in which part of the second portion of the curved surface of the bag support is underneath the base, and an extended position in which the part of the second portion of the curved surface of the bag support is extended beyond the base to contact and support the bag of material.

18. An extendable bag roller for supporting a bag of material during removal of the material from the bag, the extendable bag roller comprising:

a bag support having a curved surface configured to support the bag of material on the curved surface, the bag support comprising:

a base defining a first portion of the curved surface of the bag support; and an extension defining a second portion of the curved surface of the bag support, the extension being moveable to selectively increase and decrease the area of the curved surface of the bag support to accommodate different bag sizes; and a roller that rolls along the curved surface of the bag support to squeeze the material out of the bag;

wherein the second portion of the curved surface of the bag support is positioned underneath the base such that the extension is fully below the base when the extension is in a fully retracted position.

19. An extendable bag roller for supporting a bag of material during removal of the material from the bag, the extendable bag roller comprising:

a bag support having a curved surface configured to support the bag of material on the curved surface, the bag support comprising:

a base defining a first portion of the curved surface of the bag support; and an extension defining a second portion of the curved surface of the bag support, the extension being moveable to selectively increase and decrease the area of the curved surface of the bag support to accommodate different bag sizes; and a roller that rolls along the curved surface of the bag support to squeeze the material out of the bag;

wherein the second portion of the curved surface of the bag support is substantially seamless with the first portion of the curved surface of the bag support when the extension is in an extended position.

20. An extendable bag roller for supporting a bag of material during removal of the material from the bag, the extendable bag roller comprising:

a bag support having a curved surface configured to support the bag of material on the curved surface, the bag support comprising:

a base defining a first portion of the curved surface of the bag support; and an extension defining a second portion of the curved surface of the bag support, the extension being moveable to selectively increase and decrease the area of the curved surface of the bag support to accommodate different bag sizes;

a roller that rolls along the curved surface of the bag support to squeeze the material out of the bag; and graduation marks located on the extension.

* * * * *